US008353229B1

(12) United States Patent
Muhareb

(10) Patent No.: US 8,353,229 B1
(45) Date of Patent: Jan. 15, 2013

(54) DUAL-HEAD ALIGNING WRENCH

(76) Inventor: Imad I. Muhareb, Palm Springs, CA (US)

( * ) Notice: Subject to any disclaimer, the term of this patent is extended or adjusted under 35 U.S.C. 154(b) by 311 days.

(21) Appl. No.: 12/798,662

(22) Filed: Apr. 9, 2010

(51) Int. Cl.
*B25B 13/06* (2006.01)

(52) U.S. Cl. ..... 81/55

(58) Field of Classification Search ..... 81/55, 184, 81/177.2, 177.4, 165, 145, 157, 126–129.5, 81/170, 173; 269/45, 43, 154; 72/409.12, 72/479

See application file for complete search history.

(56) References Cited

U.S. PATENT DOCUMENTS

| | | | | |
|---|---|---|---|---|
| 599,334 | A | 2/1898 | Kahl | |
| 737,847 | A | 9/1903 | Johnson | |
| 836,437 | A | 11/1906 | Cochran | |
| 1,237,122 | A | 8/1917 | Suomy | |
| 1,365,784 | A | 1/1921 | Husson | |
| 2,574,227 | A | 4/1948 | Sarvie | |
| 2,836,139 | A * | 5/1958 | Holmberg | 269/45 |
| 3,704,503 | A | 12/1972 | Haywood | |
| 3,828,413 | A | 8/1974 | Province et al. | |
| 4,258,597 | A * | 3/1981 | Gelman | 81/184 |
| 4,378,937 | A | 4/1983 | Dearman | |
| 4,568,109 | A | 2/1986 | Prueter | |
| 4,872,709 | A | 10/1989 | Stack | |
| 4,943,039 | A * | 7/1990 | Jackson | 269/45 |
| 4,960,016 | A * | 10/1990 | Seals | 81/177.4 |
| 6,595,089 | B1 * | 7/2003 | Stojanowski | 81/165 |
| 6,938,525 | B2 | 9/2005 | Poole et al. | |
| 7,137,321 | B1 * | 11/2006 | Huang | 81/126 |
| 7,182,000 | B1 * | 2/2007 | Dicksen | 81/177.2 |
| 7,237,425 | B1 * | 7/2007 | Wadsworth et al. | 72/409.12 |

* cited by examiner

*Primary Examiner* — Robert Pezzuto
(74) *Attorney, Agent, or Firm* — Albert O. Cota

(57) ABSTRACT

A dual-head aligning wrench (10) (DHAW 10) that allows a single person to align, grip and attach two interfacing workpieces (130). The DHAW (10) consists of a first adjustable wrench (12) and a second adjustable wrench (74) that operate in combination to secure the workpieces (130). The first adjustable wrench (12) has a first wrench housing (14) that encloses a ratcheting mechanism (40), and a ratcheting handle (64) having a front end (68) that operates the ratcheting mechanism (40); a second adjustable wrench (74) having a second wrench housing (76) concentrically aligned with the first wrench housing (14). A fixed handle (94) is attached to the second wrench housing (76) and includes a post bore (98). The two wrench housings (14,76) are attached to each other by an anti-rotation post (100) having an upper end (102) attached to the first wrench housing (14) and a lower end (104) inserted into the post bore (98). The post (100) maintains the first wrench housing (14) in concentric alignment with the second wrench housing (76).

8 Claims, 6 Drawing Sheets

DUAL-HEAD ALIGNING WRENCH

TECHNICAL FIELD

The invention generally pertains to wrenches, and more particularly to a dual-head aligning wrench that allows a single person to concentrically align, grip and attach two workpieces.

BACKGROUND ART

Construction work utilizes a wide variety of tools that are chosen for whatever particular task(s) is being performed. Certain tools such as a hammer or wrench are ubiquitous and utilized by many construction workers for a number of various purposes.

Among tools such as wrenches there are often many configurations, with each designed to facilitate a specific function. One such wrench that is found in the prior art and has been designed for a specific purpose is a combination aligning and tightening wrench.

In theory, these types of wrenches are supposed to be capable of aligning two separate workpieces, such as lengths of pipe, and then tightening the two workpieces together. While some prior art designs function better than others, none of them is fully capable of adequately and reliably performing the task for which they were designed. This is unfortunate because there is a significant need for this type of wrench.

Obviously, is would be extremely beneficial if there was a fully functioning and reliable wrench that would allow an individual to single-handily align and tighten two workpieces. A wrench with this functionally would be especially useful in tight working environments where space is extremely limited and it is often possible to only utilize a single hand to manipulate and use a wrench.

A search of the prior art did not disclose any literature or patents that read directly on the claims of the instant invention. However, the following U.S. patents are considered related:

| U.S. Pat. No. | INVENTOR | ISSUED |
|---|---|---|
| 6,938,525 | Poole, et al | Sep. 6, 2005 |
| 4,872,709 | Stack | Oct. 10, 1989 |
| 4,378,937 | Dearman | Apr. 5, 1903 |

The U.S. Pat. No. 6,938,525 discloses a pipe wrench having a uniquely handy control lever and a one-way ratchet for very rapid adjustment of the wrench's position. The wrench also has a pivoting upper jaw that further aids a user in adjusting and tightening the wrench while using only one hand. The wrench can also be used to clamp an object or workpiece.

The U.S. Pat. No. 4,872,709 discloses a toggle clamp that is fitted with opposed pipe flange engaging jaws. The clamp provides a rapid means of alignment and positioning of flanged pipe during assembly; particularly suited for use with split "V" clamp joints.

The U.S. Pat. No. 4,378,937 discloses a pipe welder's aligning tool for use in joining two pipe members end to end. The tool comprises a clamp having a pair of jaws movable toward and away from one another so as separably to clamp one pipe member adjacent its end. The jaws carry supports that extend beyond the one end of the clamped pipe to provide support for the confronting end of a second pipe member that is to be joined to the clamped pipe. One of the jaws may be mounted on an elongated member that is adjustable to enable the tool to be used on pipes of differing diameters.

For background purposes and as indicative of the art to which the invention relates, reference may be made to the following remaining patents found in the search:

| U.S. Pat. No. | INVENTOR | ISSUED |
|---|---|---|
| 4,568,109 | Prueter | Feb. 4, 1986 |
| 3,828,413 | Province et al | Aug. 13, 1974 |
| 3,704,503 | Haywood | Dec. 5, 1972 |
| 2,574,227 | Sarvie | Apr. 28, 1948 |
| 1,365,784 | Husson | Jan. 18, 1921 |
| 1,237,122 | Suomy | Aug. 14, 1917 |
| 836,437 | Cochran | Nov. 20, 1906 |
| 737,847 | Johnson | Sep. 1, 1903 |
| 599,334 | Kahl | Feb. 22, 1898 |

DISCLOSURE OF THE INVENTION

The dual-head aligning wench (DHAW) is designed to allow a single person to align, grip and attach two pipes or two solid posts that have equal or different diameters.

The posts can be comprised of any polygonal shape such as a square, triangle, hexagon or an octagon.

In its basic design, the DHAW includes a first adjustable wrench, a second adjustable wrench and an anti-rotation post.

The first adjustable wrench is comprised of:

- A first wrench housing that encloses a ratcheting mechanism, and
- A ratcheting handle having a front end that interfaces with and controls the direction of the ratcheting mechanism.

The second adjustable wrench is comprised of

- A second wrench housing that is concentrically aligned with the first wrench housing, and
- A fixed handle that is attached to the second wrench housing and that has a post bore.

The anti-rotation post has an upper end that is rigidly attached to the first wrench housing and a lower end that is dimensioned to fit into the post bore. The anti-rotation post maintains the first wrench housing in concentric alignment with the second wrench housing.

To augment the invention's operational performance, the DHAW can include a leverage rod and a pair of self-centering jaws. The leverage rod, which is removably inserted into the rear end of the fixed handle, allows the DHAW to maintain a steady grip to the upper and lower structures of the workpiece The self-centering jaws are operated by a jaws-adjusting thumb screw that is rotatably attached to the ratcheting mechanism. The jaws are designed to have a minimum opening of 0.0313 inches (0.0795 cm) and a maximum opening of 12.0 inches (30.48 cm).

In view of the above disclosure, the primary object of the invention is to provide a DHAW that is easily operated by a single person to attach two interfacing ends of a pipe or a solid rod.

In addition to the primary object of the invention, it is also an object of the invention to provide a DHAW that:

- can be made in various dimensions,
- is easily operated by only a single person,
- is maintenance free, and
- is cost effective for both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
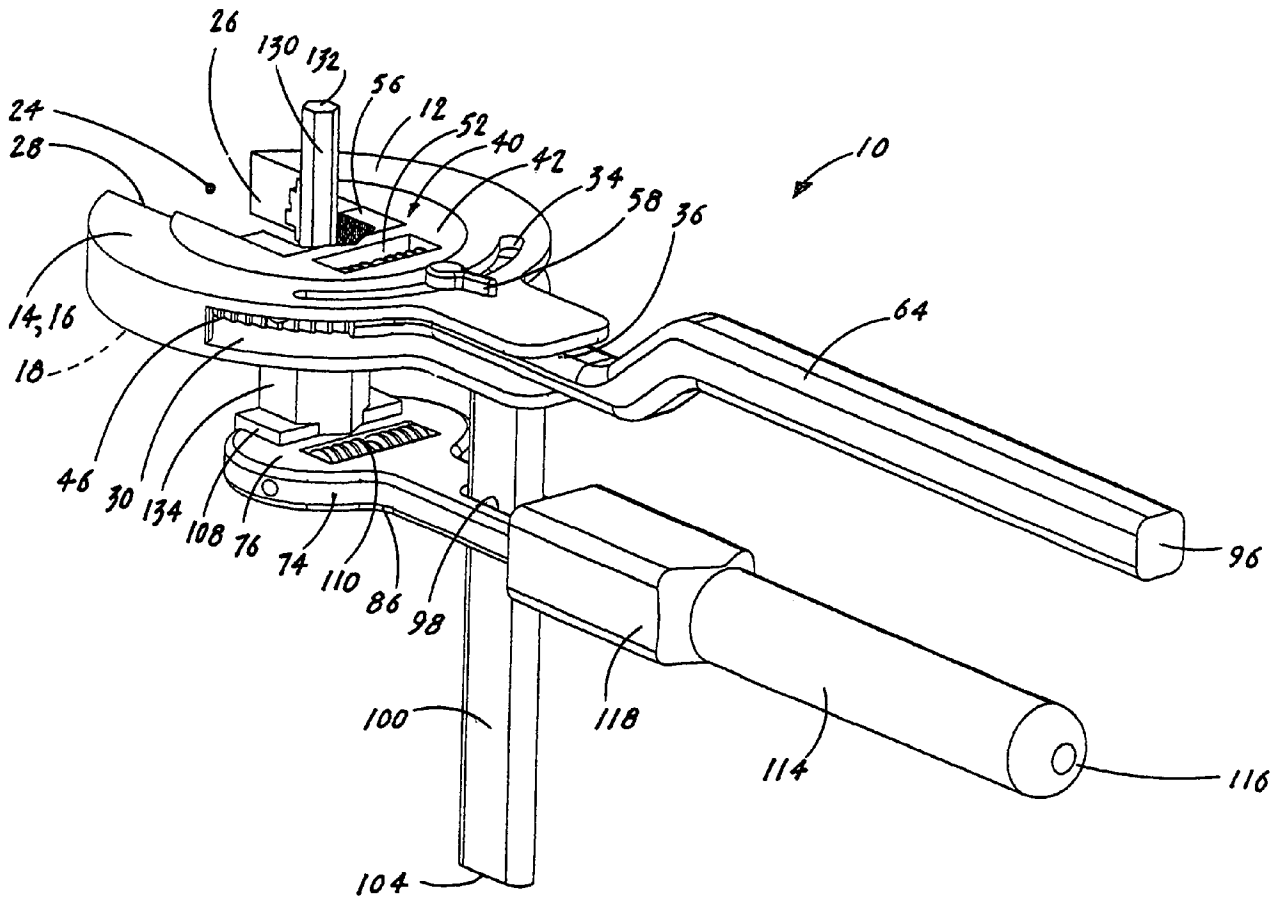
FIG. 1 is a perspective view of a dual-head aligning wrench (DHAW) shown with a two dimensioned workpiece that is attached and held between a first adjustable wrench and a second adjustable wrench, and with a ratcheting wrench handle placed in a neutral position.

The best mode for carrying out the invention is presented in terms that disclose a preferred embodiment of a dual-head aligning wrench (DHAW). The DHAW 10 allows a single person to concentrically align, grip and threadably attach the ends of two interfacing workpieces which are not a part of the DHAW.

The preferred embodiment of the DHAW 10, as shown in FIGS. 1-6, is comprised of the following major elements: a first adjustable wrench 12, a first wrench housing 14, a ratcheting mechanism 40, a pair of self-centering jaws 56, a ratcheting handle 64, a second adjustable wrench 74, a second wrench housing 76, an anti-rotation post 100, and a leverage rod 114. The above inventive elements function in combination with a workpiece 130 that can include an upper structure 132 having a first diameter and a lower structure 134 having a diameter that is equal to, greater than or less than the first diameter on the upper structure 132.

Figure 2:
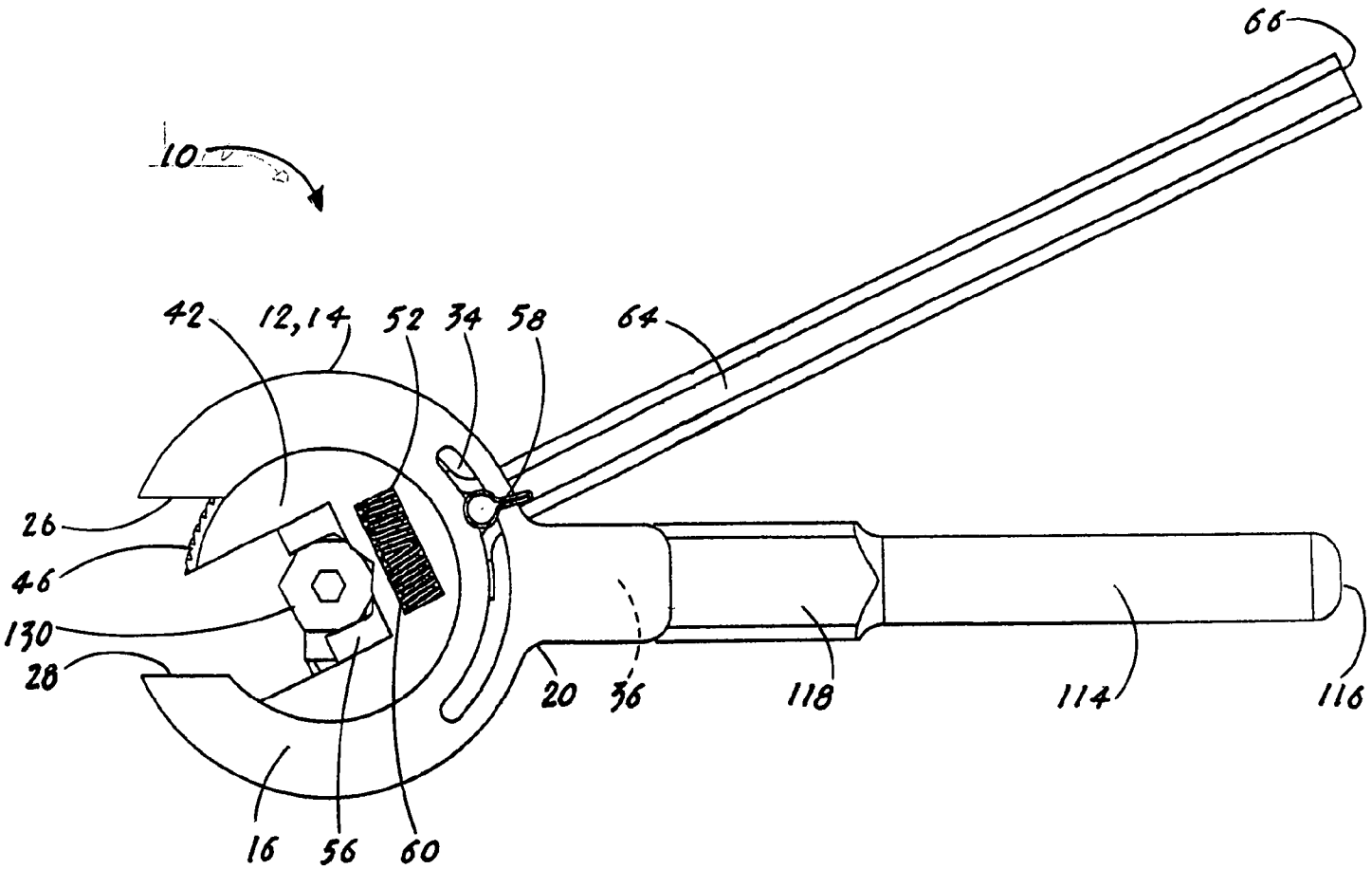
FIG. 2 is a top plan view of the DHAW shown with the ratcheting wrench handle angularly displaced.
Figure 3:
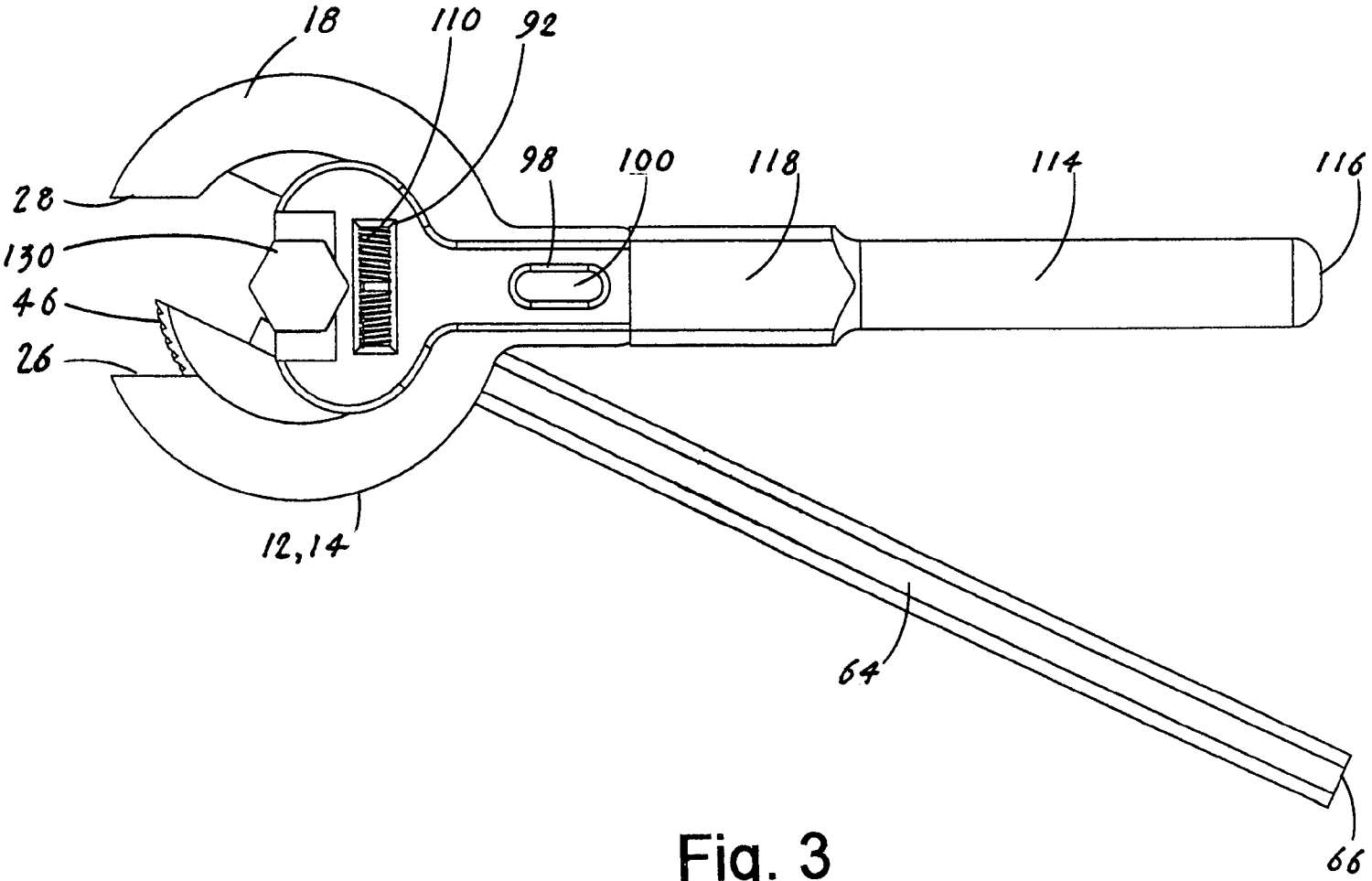
FIG. 3 is a bottom plan view shown with the ratcheting handle angularly displaced.
Figure 6:
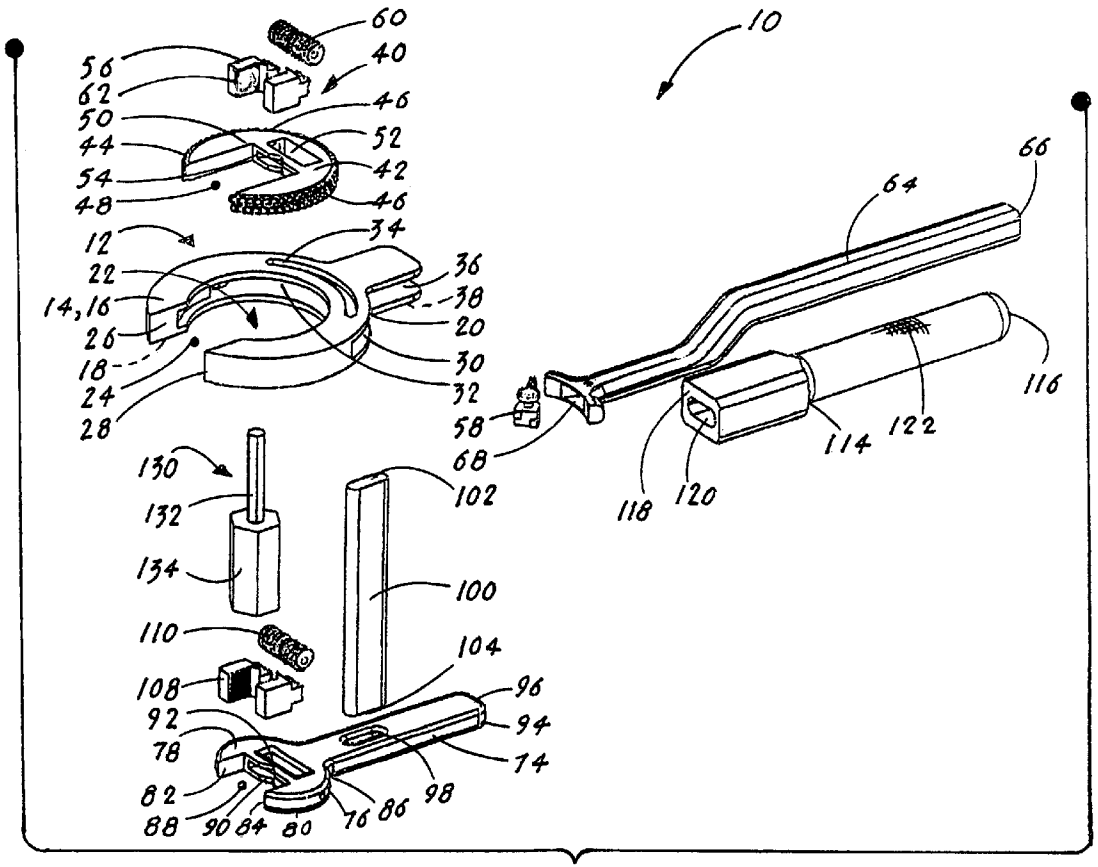
FIG. 6 is an exploded view of the DHAW.

The first adjustable wrench 12, as shown best in FIGS. 1, 2, 3 and 6, is comprised of the first wrench housing 14 that includes an upper surface 16, a lower surface 18, a rear side 20 and a central opening 22. The central opening 22, as shown in FIGS. 2 and 3, has a workpiece insertion gap 24 that is bordered by a first edge 26 and a second edge 28. Located along the rear side 20 is a handle-slide opening 30 and along the central opening 22 is a ratchet disk opening 32. As shown in FIGS. 2 and 6, a ratchet lever slot 34 extends along the upper surface 16 and adjacent the rear side 20. Also along the upper surface 16 and the lower surface 18 is a handle guard slot 36, as shown in FIGS. 1 and 6.

The ratcheting mechanism 40, as shown best in FIG. 6, is comprised of a ratchet disk 42 having an outer surface 44 that further has a pair of opposed gear teeth sections 46, as shown in FIG. 1. The ratchet disk 42 is inserted into the ratchet disk opening 32, as best shown in FIG. 6. The disk 42 has a workpiece insertion gap 48 that is in alignment with the workpiece insertion gap 24 located on the first wrench housing 14. Located within the workpiece insertion gap 48 is a jaws insertion cavity 50, and from the upper surface of the disk 42 and adjacent the jaws insertion cavity 50 is a jaw screw cavity 52 having a rear surface 54, as shown in FIGS. 2 and 6.

Figure 5:
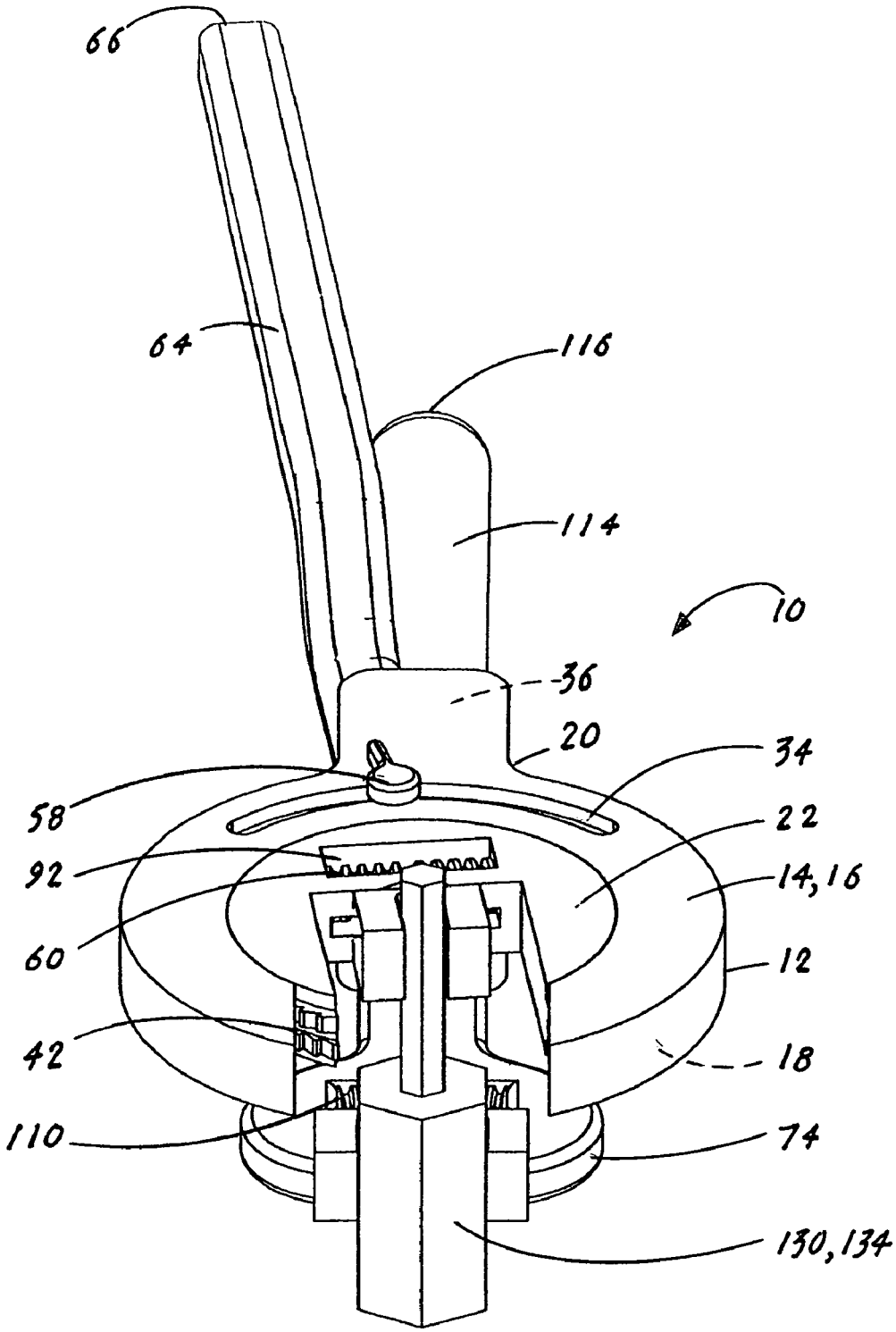
FIG. 5 is a front perspective-elevational view of the DHAW shown with a two dimensioned workpiece aligned and held between the two adjustable wrenches.

The pair of self-centering jaws 56, as shown in FIGS. 5 and 6, are dimensioned to be inserted into and movably held within the jaws insertion cavity 50. The jaws 56, which can have serrated gripping surfaces, are adjusted, as shown in FIGS. 2 and 6, by means of a jaws adjusting thumb screw 60. The screw 60, which is designed to default to a neutral centered position, is rotatably attached within the jaw screw cavity 52. When in place, the thumb screw 60 interfaces with the gear teeth sections 46 and the ratchet disk 42. The tightening or loosening of a workpiece 130 is selected by a ratcheting direction lever 58 that is located within the ratchet lever slot 34. By adding a blade 62 to at least one side of the self-centering jaws 56, as shown in FIG. 6, the DHAW 10 can function as a pipe cutting tool.

Figure 4:
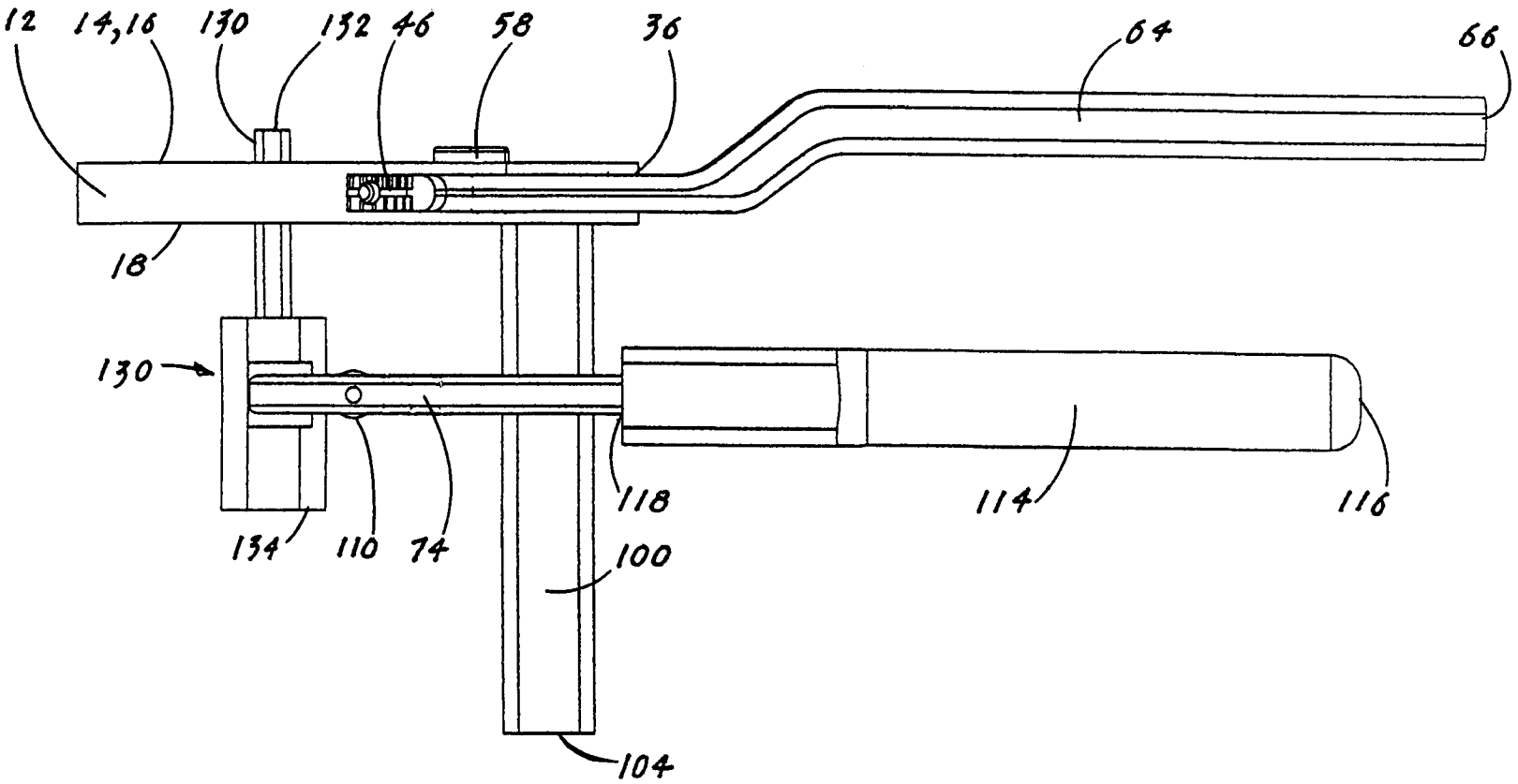
FIG. 4 is a side elevational view of the DHAW shown with a two dimensioned workpiece aligned and held between the two adjustable wrenches.

The final element that comprises the first adjustable wrench 12 is the ratcheting handle 64, as shown in FIGS. 1 and 4. The handle 64 has a rear end 66 and a front end 68 that is dimensioned to movably fit into a handle guard slot 36. The handle 64 operates in combination with the ratcheting direction lever 58 to secure the upper structure 132 of the workpiece 130.

The second major element that comprises the DHAW 10 is the second adjustable wrench 74, as shown in FIGS. 1, 4 and 6, which includes a second wrench housing 76. The housing 76 has an upper surface 78, a lower surface 80, a first edge 82, a second edge 84 and a rear side 86. The housing 76 also has a workpiece insertion gap 88 that extends from the first and second side edges 82,84 and terminates inward at a centered angled surface 90. The surface 90 preferably is comprised of a V-slot that is dimensioned to securely retain an edge of a polygonal post. Extending from the upper surface 78 is a jaw screw cavity 92 and extending from the rear side 86 is an integral handle 94 that includes a post bore 98, as shown in FIG. 6.

The anti-rotation post 100, as shown in FIGS. 1, 4 and 6, allows the two wrenches 12 and 74 to remain in a constant alignment with the upper structure 132 and the lower structure 134 of the workpiece 130. The post 100 has an upper end 102 and a lower end 104. The upper end 102 preferably, is integrally attached to the lower surface 38 of the handle guard slot 36 located on the first wrench housing 14. The lower end 104, as shown in FIGS. 1 and 6, is inserted into and held within the post bore 98.

A pair of self-centering jaws 108, which can also have serrated gripping surfaces, are dimensioned to interface with the centered angled surface 90 that is located on the second wrench housing 76. The jaws 108 are operated by a self-centering jaw screw 110 that is rotatably attached within the jaw screw cavity 92. The angled surface 90 can consist of a V-slot that is dimensioned to securely retain an edge of a polygonal post.

The final element that comprises the second adjustable wrench 74 is the leverage rod 114, as shown in FIGS. 1, 2 and 3. The rod 114 has a rear end 116 and a front end 118 which has a handle cavity 120 that is dimensioned to receive and hold the rear end 96 of the handle 94. The leverage rod 114 aids in maintaining an aligned grip on the upper structure 132 and the lower structure 134 of the workpiece 130. As shown in FIG. 4, the rear section of the ratcheting handle 64 extends upward to provide additional clearance with the leverage rod 114. The leverage rod 114, as shown in FIG. 6 can include a knurled surface 122.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

DUAL-HEAD ALIGNING WRENCH
Element Designation
(For convenience of the Examiner, not part of the specification)

| | |
|---|---|
| 10 | Dual-Head Aligning Wrench (DHAW) |
| 12 | First Adjustable Wrench |
| 14 | First Wrench Housing |
| 16 | Upper Surface |
| 18 | Lower Surface |
| 20 | Rear Side |
| 22 | Central Opening |
| 24 | Workpiece Insertion Gap |
| 26 | First Edge |
| 28 | Second Edge |
| 30 | Handle-Slide Opening |
| 32 | Ratchet Disk Opening |
| 34 | Ratchet Lever Slot |
| 36 | Handle Guard Slot |
| 38 | Lower Surface |
| 40 | Ratcheting Mechanism |
| 42 | Ratchet Disk |
| 44 | Outer Surface |
| 46 | Pair of Opposed Gear Teeth |
| 48 | Workpiece Insertion Gap |
| 50 | Jaws Insertion Cavity |
| 52 | Jaw Screw Cavity |
| 54 | Rear Surface |
| 56 | Self-Centering Jaws |
| 58 | Ratcheting Direction Lever |
| 60 | Jaws Adjusting Thumb Screw |
| 62 | Blade |
| 64 | Ratcheting Handle |
| 66 | Rear End |
| 68 | Front End |
| 70 | |
| 72 | |
| 74 | Second Adjustable Wrench |
| 76 | Second Wrench Housing |
| 78 | Upper Surface |
| 80 | Lower Surface |
| 82 | First Edge |
| 84 | Second Edge |
| 86 | Rear Side |
| 88 | Workpiece Insertion Gap |
| 90 | Centered Angled Surface |
| 92 | Jaw Screw Cavity |
| 94 | Handle |
| 96 | Rear End |
| 98 | Post Bore |
| 100 | Anti-Rotation Post |
| 102 | Upper End |
| 104 | Lower End |
| 106 | |
| 108 | Self-Centering Jaws |
| 110 | Self-Centering Jaw Screw |
| 112 | |
| 114 | Leverage Rod |
| 116 | Rear End |
| 118 | Front End |
| 120 | Handle Cavity |
| 122 | Knurled Surface |
| 124 | |
| 126 | |
| 128 | |
| 130 | Workpiece |
| 132 | Upper Structure |
| 134 | Lower Structure |

The invention claimed is:

1. A dual-head aligning wrench (DHAW) that allows a single person to concentrically align, grip and attach two interfacing workpieces, said DHAW comprising:

A. a first adjustable wrench comprising:

a) a first wrench housing having:

(1) an upper surface and a lower surface, (2) a rear side and a frontal central opening having a workpiece insertion gap that is bordered by a first edge and a second edge, (3) a handle-slide opening that extends along the rear side, (4) a ratchet disk opening that extends along the central opening, (5) a ratchet lever slot that extends along the upper surface and adjacent the rear side, and (6) a handle guard slot that extends from the rear side along the upper surface and the lower surface, b) a ratcheting mechanism comprising:

(1) a ratchet disk having an outer surface further having a pair of opposed gear teeth sections, wherein said disk is inserted into the ratchet disk opening, said ratchet disk further having a workpiece insertion gap that is in alignment with the workpiece insertion gap located on said first wrench housing, a jaws insertion cavity having a rear surface and a jaw screw cavity that extends from the upper surface of said ratchet disk and that is adjacent the jaws insertion cavity, (2) a pair of self-centering jaws that are inserted into and movably held within the jaws insertion cavity, (3) a jaws adjusting thumb screw that is rotatably attached within the jaw screw cavity and that interfaces with the gear teeth section on the ratchet disk, and (4) a ratcheting direction lever that is held within the ratchet lever slot c) a ratcheting handle having a rear end and a front end that is dimensioned to movably fit into a handle guard slot that operates in combination with the ratcheting direction lever, B. a second adjustable wrench comprising:

a) a second wrench housing having:

(1) an upper surface, a lower surface, a first edge, a second edge and a rear side, (2) a workpiece insertion gap that extends from the first and second side edges and terminates inward at a centered angled surface, (3) a jaw screw cavity that extends from the upper surface, (4) an integral handle extending from the rear side and that terminates with a rear end, said handle further having a post bore, b) an anti-rotation post having an upper end that is integrally attached to the lower surface of the handle guard slot and a lower end that is inserted into the post bore, c) a pair of self-centering jaws that interface with the centered angled surface located on said second wrench housing, d) a self-centering jaw screw that is rotatably attached within the jaw screw cavity, and e) a leverage rod having a rear end, and a front end having a handle cavity that is dimensioned to receive and hold the rear end of the integral handle.

2. The DHAW as specified in claim 1 wherein the workpiece is comprised of a) a first pipe having a diameter that interfaces with a second pipe having a diameter that is identical to the first pipe's diameter, b) a first solid post having a first diameter that interfaces with a second solid post having a diameter that is identical to the first pipe's diameter, c) a first pipe or solid post having a diameter that interfaces with a solid post or pipe having a diameter that is different than the first pipe's or post's diameter.

3. The DHAW as specified in claim 1 wherein said wrench is designed to hold a workpiece that is comprised of a) a first pipe having a diameter that interfaces with a second pipe having a diameter that is identical to the first pipe's diameter, b) a first solid post having a diameter that interfaces with a second solid post having a diameter that is identical to the first pipe's diameter, and c) a first pipe or solid post having a diameter that interfaces with a solid post or pipe having a diameter that is different than the pipe's or post's diameter.

4. The DHAW as specified in claim 1 wherein the rear surface of the jaws insertion cavity has a centered V-slot designed to securely retain an edge of the polygonal solid post.

5. The DHAW as specified in claim 1 wherein the self-centering jaw adjustment screw is spring-loaded to allow the screw to default to a neutral centered position.

6. The DRAW as specified in claim 1 wherein the upper end of said anti-rotation post is integral with the lower surface of the handle guard slot.

7. The DHAW as specified in claim 1 wherein the rear section of said ratcheting handle extends upward to provide additional clearance with the leverage rod.

8. The DHAW as specified in claim 1 further comprising a blade that extents from at least one side of the self-centering jaws wherein the blade(s) allow said DHAW to function as a pipe cutting tool.

* * * * *